United States Patent [19]

Megerle et al.

[11] 4,315,620

[45] Feb. 16, 1982

[54] STACK FOR THE THERMAL TREATMENT OF MATERIAL

[75] Inventors: Friedrich Megerle; Jörg Krüger, both of Cologne, Fed. Rep. of Germany

[73] Assignee: Klockner-Humboldt-Deutz AG, Fed. Rep. of Germany

[21] Appl. No.: 133,906

[22] Filed: Mar. 25, 1980

[30] Foreign Application Priority Data

Apr. 19, 1979 [DE] Fed. Rep. of Germany ..... 2915771

[51] Int. Cl.[3] ..... C21B 7/10

[52] U.S. Cl. ..... 266/193; 266/194

[58] Field of Search ..... 266/193–199

[56] References Cited

U.S. PATENT DOCUMENTS 2,465,463 3/1949 Lindemuth ..... 266/193

3,706,343 12/1972 Saiga ..... 266/193

*Primary Examiner*—P. D. Rosenberg

*Attorney, Agent, or Firm*—Hill, Van Santen, Steadman, Chiara & Simpson

[57] ABSTRACT

Wall structure for a smelting stack is comprised of a cooling fluid flow pipe membrane layer comprised of a series of vertical, parallel arranged pipes extending between upper and lower manifold members. The pipe membrane completely surrounds a hot zone in the smelting stack. The upper and lower manifolds extend interiorly of the pipe wall membrane to define an alcove in which there is positioned a series of vertically arranged lengths of insulation cladding which are spaced from one another by gaps filled with fire-proof materials. The gaps contain elements of the pipe membrane layer directed interiorly of the pipe membrane. A waste-gas stack may be mounted directly adjacent the smelting stack with a common wall therebetween. The waste-gas stack wall comprises only a pipe membrane. The primary function of the stack wall structure in the waste-gas stack is to remove heat from the waste gases; whereas, the primary function in the smelting stack is to retain heat within the stack and enable the furnace wall structure to withstand the smelting heat. A common wall serves both these functions. Since the load-bearing elements of the wall structure are the pipe membranes, the stack wall structures may be supported in a blast furnace system by suspension from the upper manifold or erection upon the lower manifold.

9 Claims, 6 Drawing Figures

STACK FOR THE THERMAL TREATMENT OF MATERIAL

BACKGROUND OF THE INVENTION

A. Field of the Invention

The invention relates to wall structure about a high temperature zone and, in particular, a blast furnace stack system for the thermal treatment of material, such as the smelting of ore concentrate.

B. The Prior Art

Typically, in known pyrometallurgical or blast furnace systems, such as disclosed in U.S. Pat. No. 3,555,164, fine-grained metalliferous ore particles are blown into a smelting stack with an oxygen-rich gas (often air). In the smelting stack, the fluid-carried ore becomes calcined and smelted. The resulting gases produced thereby, such as iron monoxide and carbon monoxide, as well as dust particulates, are withdrawn from the smelting stack into a neighboring waste-gas stack. The smelt iron and slag produced from the ore collects at the bottom of the smelting stack in a molten bath, which passes beneath a partition member into a settling furnance for further treatment of the smelt and removal of the slag. If the treated ore is of a sufficiently high sulfur content, then enough heat can be generated by combustion of the sulfide sulfur so that the calcining and smelting operation in the smelted stack may autogenously occur, obviating the need for fuel addition in the smelting stack.

The furnace walls within the smelting stack come into contact with very hot gases as well as molten metal falling to the slag bath. Accordingly, the furnace walls must be made impervious to heat. Prior art techniques for doing this include providing a furnace wall made up of fire-proof stone provided internally with cooling channels containing flows of cooling liquid, such as water, therethrough. However, the incorporation of cooling channels in the fire-proof material results in a weakening of the furnace wall such that the furnace wall is unable to bear the loads necessary for its suspension over the molten bath.

SUMMARY OF THE INVENTION

The present invention overcomes the above-mentioned disadvantages in presently known furnace wall arrangements by affording fire-proof walls able to withstand high temperatures with the existence of cooling channels and, at the same time, exhibit high-strength load bearing characteristics. Further, the wall structure of the present invention is economical and simple to manufacture.

The present invention wall structure utilizes a pipe membrane layer, comprising vertical flow pipes extending parallel to one another and connected between a lower manifold supply of cooling fluid and an upper fluid receiver means, for a smelting stack. A series of lengths of insulation material are arranged along the interior sides of the pipe walls. The upper and lower manifolds project inwardly such that the insulation layer also extends between them. Gaps between adjacent insulative strips are filled with fire-proof materials, such as stones, and contain pipe membrane elements. The pipe membrane elements comprise vertical flow pipes in short rows which project inward from the pipe membrane layer and are connected at their upper and lower ends with the receiving and supply manifolds. The upper receiver or manifold, in the case of a water cooling fluid, receives the cooling fluid in the form of steam, such that the pipe membrane structure serves as a steam boiler. The steam and hot water are removed from the upper manifold to a steam collector drum. The entire stack wall can be suspended from the upper manifold or, on the other hand, erected on the lower, base manifold. Heat flow from the smelting stack is low due to the low thermal conductivity of the insulation and other fire-proof materials. Heat flux from outside the smelting stack toward the interior is high due to the pipe membrane wall structure. Accordingly, a waste-stack in which hot exhaust gases from the smelting stack flow and need to be cooled as quickly as possible for purposes of further downstream cleaning can be positioned juxtaposed with the smelting stack such that one pipe membrane wall may form a common wall with the smelting stack and waste-gas stack. The waste-gas stack may be formed of pipe membrane walls extending between upper and lower manifolds, connected with and forming a part of the pipe membrane layer in the smelting stack.

DESCRIPTION OF THE PREFERRED EMBODIMENTS

Figure 1:
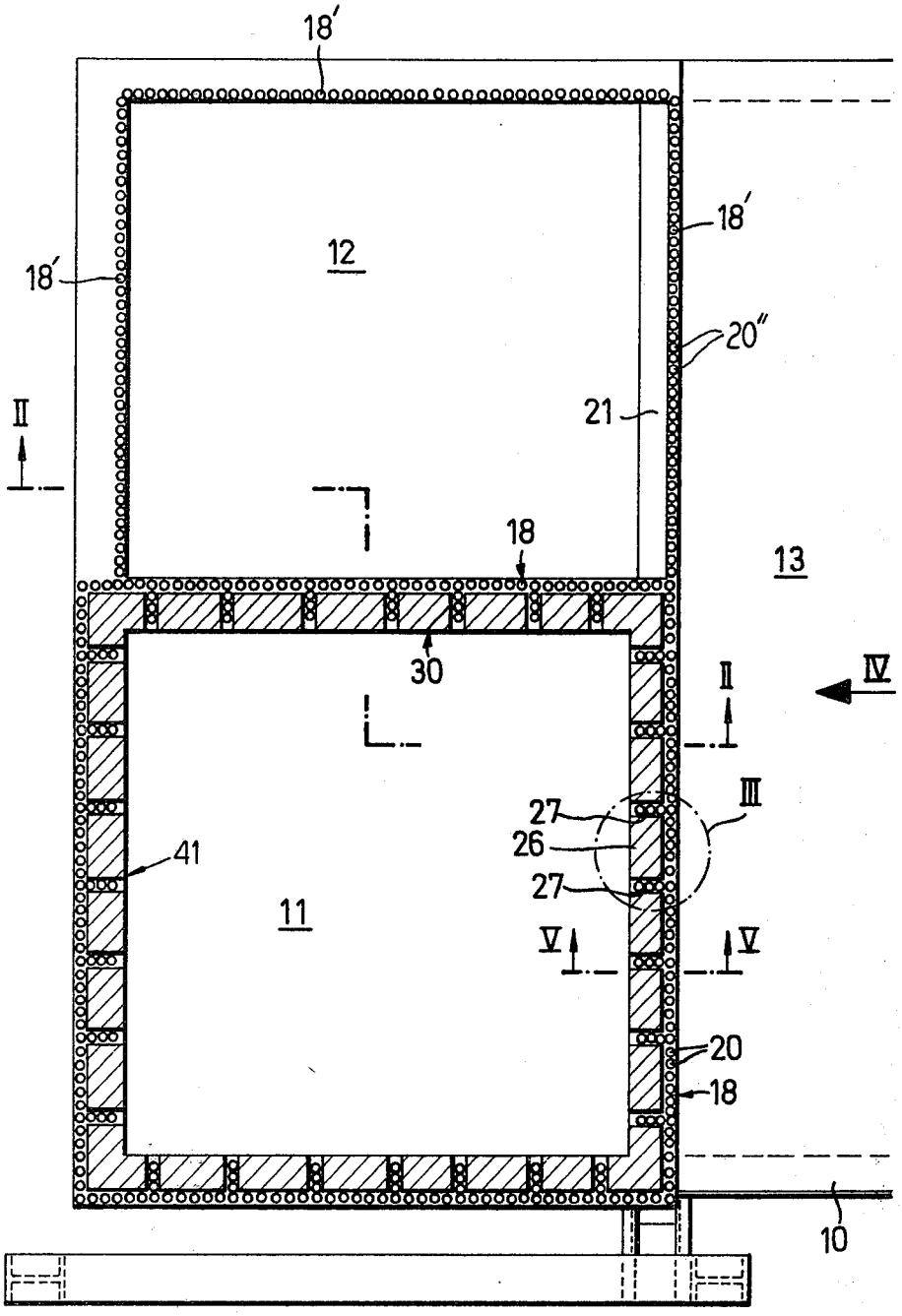
FIG. 1 is a top elevational view taken along a horizontal section through a juxtaposed smelting stack and waste-gas stack according to the present invention.

The Figures show a pyrometallurgical or blast furnace system which is intended for smelting fine-grained sulfidic lead ore concentrate. Within a common housing 10 of the blast furnace, there is contained a smelting stack 11, a waste-gas stack 12, and a settling furnace 13, which may be heated by electrical resistance heating means in known fashion. Sulfidic ore particles are blown into the vertical smelting stack 11 from the top, as shown in FIG. 1, with a stream of oxygen-rich gas, such as air, or a technically pure oxygen. The heat of combustion within the smelting stack is of such high temperatures that the ore concentrate is calcined and melted in the smelting stack instantly while it is still in a suspended state. Combustion of the sulfide sulfur and, possibly, other oxidizable components in the fluid carrier atmosphere will usually already supply sufficient heat in order to allow the calcining and smelting operation to proceed autogenously.

Smelt and slag collect at the bottom of the smelting stack 11. The heavier smelt collects in a space 14 along the bottom of the blast furnace. Molten slag floats on the smelt at the bottom of the furnace. Exhaust gases together with dust arising in the smelting process are withdrawn from the smelting stack 11 into the juxtaposed, neighboring waste-gas stack 12. From there, the gas and dust are withdrawn through the top of the stack 12 into a cleansing unit prior to being passes to the ambient.

The smelt flows under the lower edge of a vertical partition member 15, which extends into the slag bath from the top, and into settling furnace 13. In the settling furnace, the slag is separately removed and racked for further processing; while the smelt may be further reduced (e.g., by introducing coking material) to precipitate the particular desired mineral elements. The top surface of the molten bath, at which slag collects, is of even height beneath the smelting stack 11 and in the settling furnace 13. The maximum level of the slag bath is indicated by the line 16 in FIG. 1; and the minimum level is indicated by the line 17. The partition 15 prevents the intermixture of gases from treatment zones within the smelting and waste-gas stacks with gases from the reduction processes within the settling furnace 13. In this manner, the partition 15 enables mutually independent atmospheres to be maintained in both zones.

In the smelting stack 11, a furnace wall 41 is provided. The furnace wall is defined by a self-supported, load-bearing membrane wall or lining surface 18 which surrounds the stack. The membrane wall 18 is comprised of a generally annular array of vertically extending cooling flow pipes 20. The pipes 20 are all connected at their lower ends to a horizontally disposed, lower manifold 21, which is disposed along all four sides of the stack so as to surround a hot zone in the stack with the pipe membrane 18. The upper ends of the pipes are all connected with a horizontally disposed, upper manifold 22, which likewise surrounds the stack 11 respective with the pipe membrane. The pipes 20 serve to contain a flow of cooling fluid, which, for example, may be water as will be hereinafter described.

Figure 2:
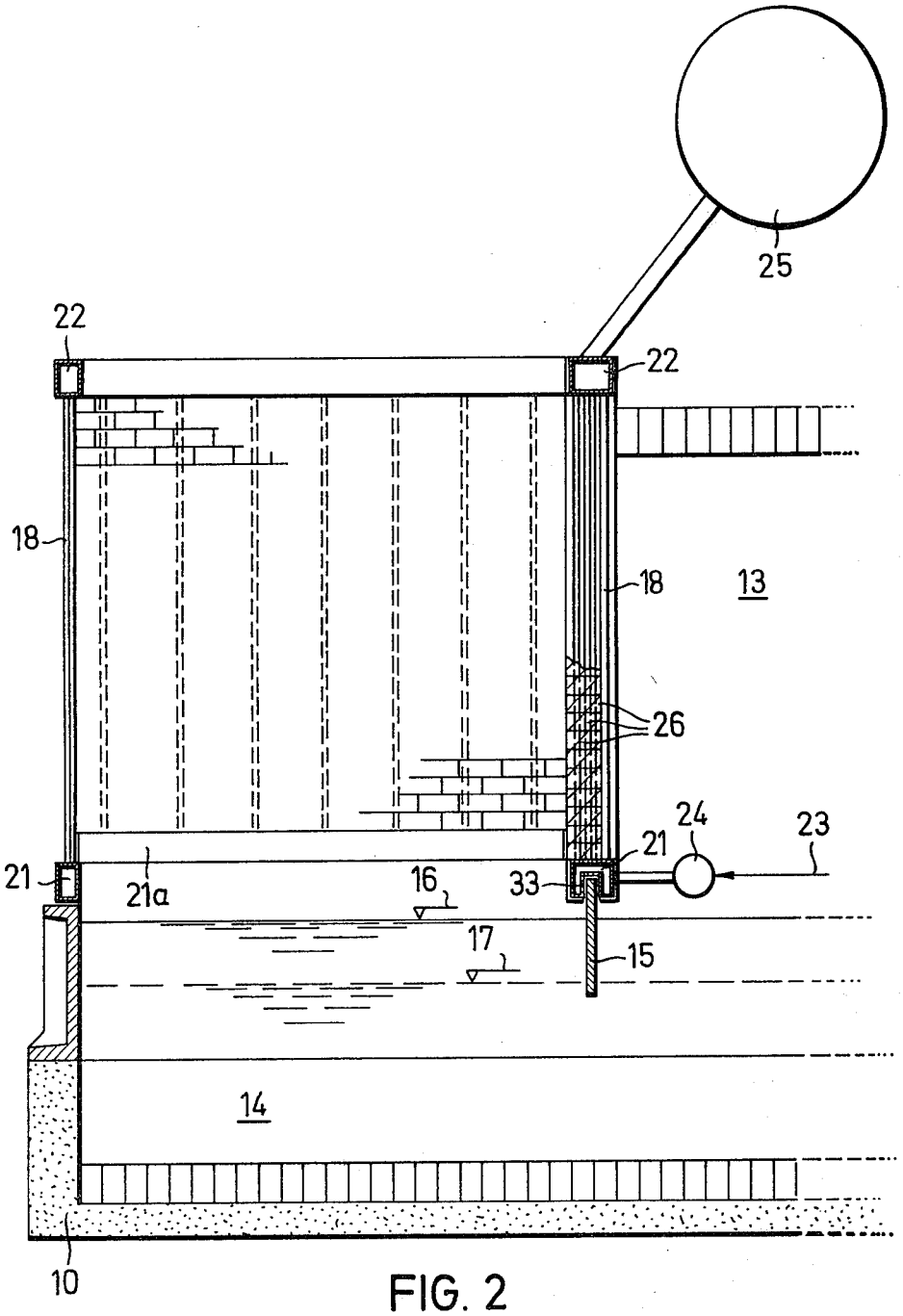
FIG. 2 is a cross-sectional view taken along the lines II—II of FIG. 1.
Figure 3:
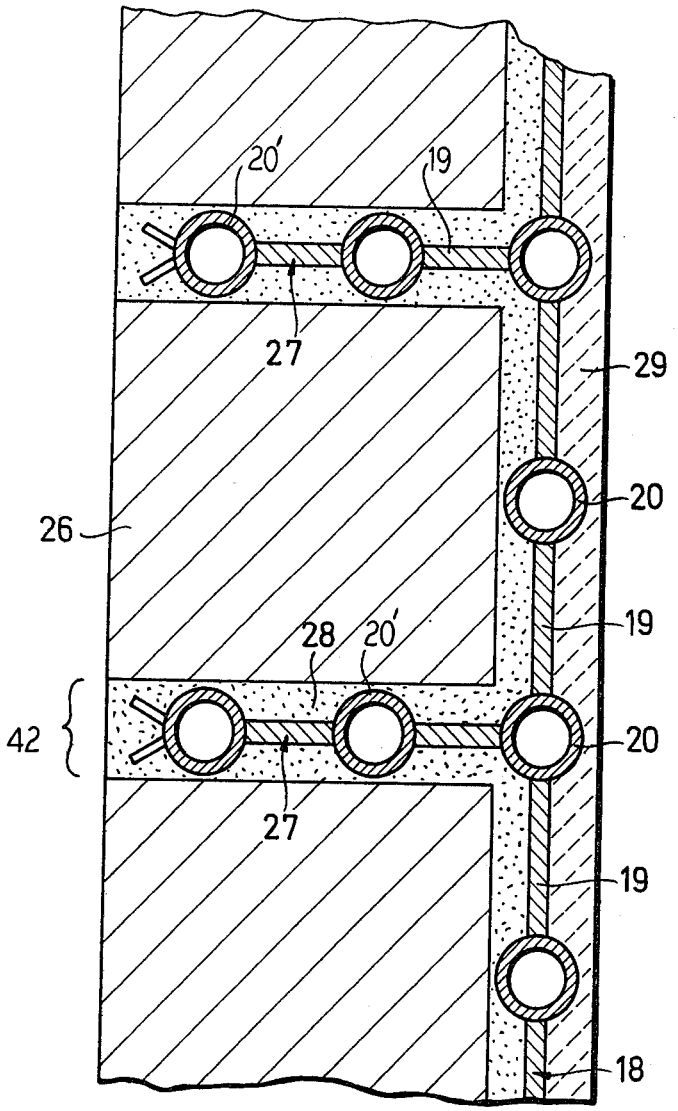
FIG. 3 is a fragmentary cross-sectional view of the furnace wall detail III of FIG. 1.

As illustrated in FIG. 2, water 23 is introduced into a supply tank 24 which feeds the lower manifold collectors 21. The water then flows from the collectors up through the membrane pipes 20 into the upper collector 22. Due to the excessive heat within the smelting stack, much of the water will be converted into steam upon reaching the manifold collectors 22. The steam and hot water received in the upper manifold 22 may then be passed into a steam reservoir or collector 25, for example, for power or heating purposes.

The lower and upper manifolds extend inwardly of the pipe membrane walls 18 toward the interior of the stack 11 so as to provide an alcove space interiorly of the pipe membrane 18. Extending within this alcove space about the interior of the smelting stack 11 are a series of vertical lengths of heat insulation cladding 26. Each length of insulation may be comprised of fireproof stones placed on top of one another. The cladding lengths 26, while lining the pipe membrane walls 18, are spaced apart from one another by vertical gaps 42. Within these gaps are interiorly directed sets of cooling fluid flow pipes 20', which serve as rib extension elements 27 of the pipe membrane 18. Lateral connecting walls 19 extend between adjacent pipes in the pipe membrane 18 and membrane elements 27 in order to arrange and support the flow pipe layer of the furnace wall. The walls 19 may be connected between adjacent pipes by welds.

Intermediate spaces between the pipe membrane wall 18 and the exterior-facing surfaces of the insulation lengths 26 and within the gaps 42 are filled up with fire-proof materials 28, such as loose stones. Thus, every length of fire-proof cladding 26 is surrounded by and supported by loose fire-proof material on three sides and is simultaneously water-cooled along these same three sides. The exterior surface of the pipe membrane 18 may also be insulated by means of a fire-proof monolithic lining material 29.

One wall 30 of the smelting stack 11 is shared in common with the directly adjacent waste-gas stack 12, such that the pipe membrane 18 extending exteriorly of the smelting stack 11 along the wall 30 faces the inside of the waste-gas stack 12. As shown in FIG. 1, the remaining walls of the waste-gas stack utilize only pipe membrane structure 18', which serves as a continuation of the pipe membrane layer 18. In contrast to the smelting stack, no insulation cladding is located between the array of cooling fluid pipes in the membrane layer and the interior of the waste-gas stack 12. The membrane walls 18' are comprised of vertically extending, parallel fluid flow pipes 20'' similar with the cooling pipes 20 described above. The upper and lower manifolds 22 and 21 described above extend horizontally into the waste-gas stack area and are connected with the upper and lower ends, respectively, of the pipes 20''. Accordingly, feed water entering the lower manifold 21 passes upwardly through cooling pipes for the smelting stack 11 and waste-gas stack 12 into the upper collector to be then directed into the steam and hot water reservoir 25.

As illustrated in FIG. 2, the section **21*a* of lower manifold 21 running beneath the cooling pipes in common wall portion 30 is positioned at a level spaced above the maximum molten bath level 16. The ensuing intermediate space between the common wall manifold 21*a* and the top of the molten bath is a pathway for the flow of smelting gases and dust from the smelting stack 11 into the waste-gas stack 12**.

It is desired that heat loss from the inside of the smelting stack be low by virtue of the furnace wall structure in order to retain heat which promotes the smelting process. However, the pipe membrane layer 18 and 27 performs a cooling function which enables the furnace wall to withstand the smelting heat. On the other hand, heat dissipation from the interior of the waste-gas stack 12 is desired to be high. By pre-cooling the dust-charged waste gases emanating from the smelting process with the pipe membrane, the usual downstream gas cooler unit connected with the waste-gas stack may be completely eliminated. Hence, the wall structure herein described serves to contain a heat retention zone within the smelting stack 11 and a heat removal zone within the waste-gas stack 12. Due to the dissimilar heat treatments being provided by the wall structures in the two stacks 11 and 12, the common wall member 30 serves to carry out two different tasks on its two sides.

Figure 4:
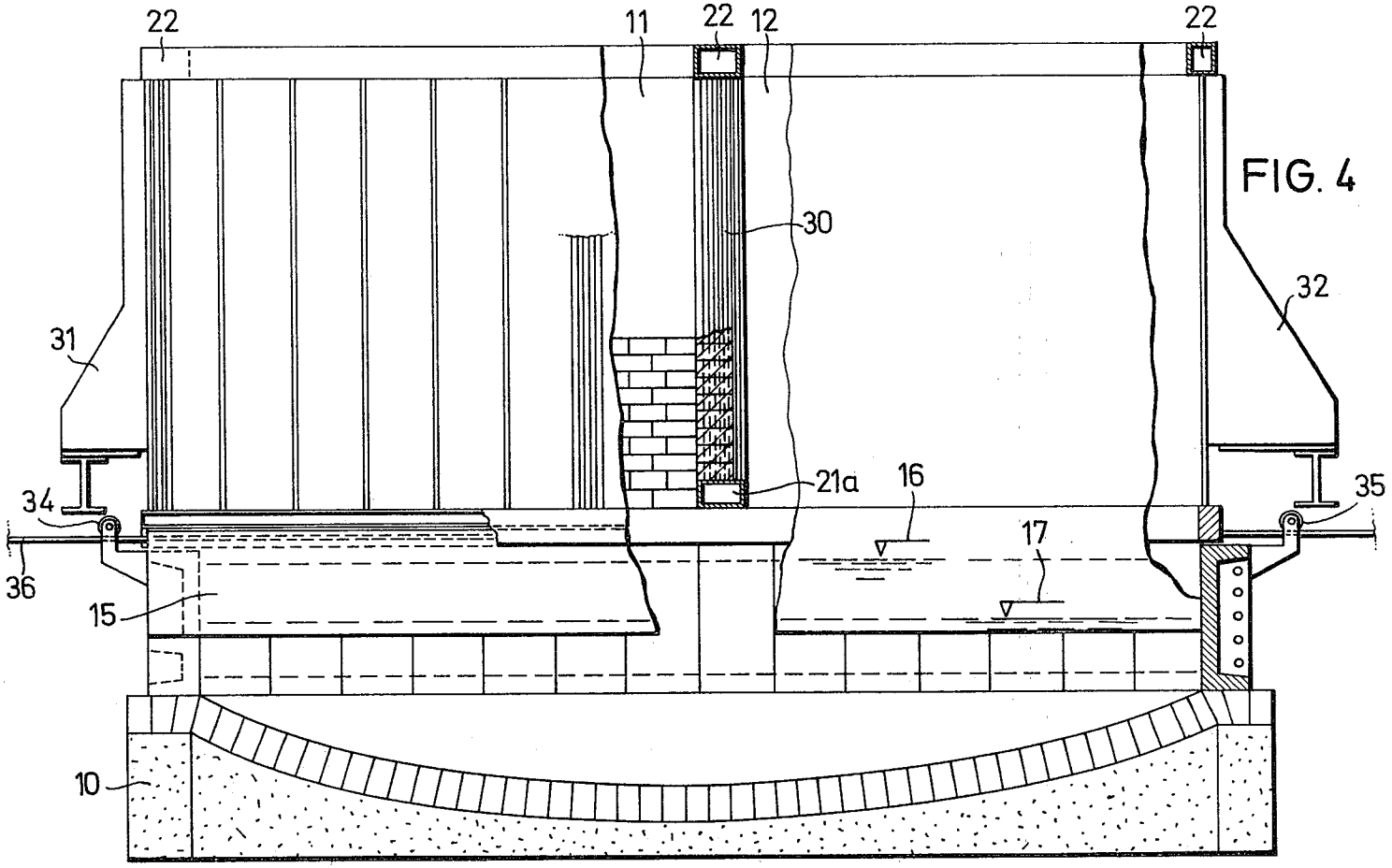
FIG. 4 is a partially broken-away vertical cross-sectional view of a blast furnace system utilizing the present invention taken in the direction of arrow IV of FIG. 1.

The pipe membrane layers 18 and 18' of the wall structure according to the present invention are the load-bearing elements with respect to erecting the walls in the stacks 11 and 12. Accordingly, the furnace walls may be suspended from the upper collectors 22, as well as supported from the lower collector 21. Suspension of the furnace wall structure according to the present invention from the upper manifold 22 of the pipe membrane walls is illustrated in FIG. 4, where the upper collectors 22 are supported on mounting arms 31 and 32 at opposed ends of the blast furnace.

Figure 5:
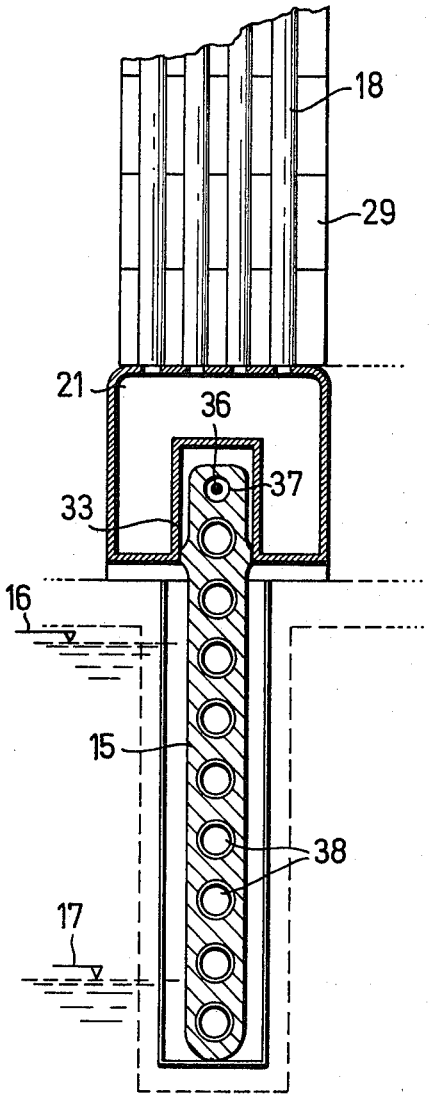
FIG. 5 is a fragmentary cross-sectional view of the partition wall member according to the present invention taken along the lines V—V of FIG. 1.
Figure 6:
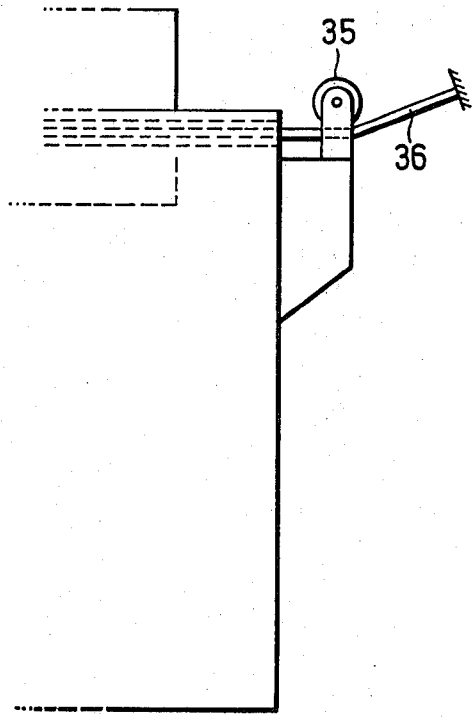
FIG. 6 is a partially schematic front elevational view of support cable means for mounting the partition member according to the present invention.

The partition wall member 15 which extends into the molten baths from above, extends from the lengths of the lower manifold 21 running beneath the sidewalls of the smelting stack 11 and waste-gas stack 12 directly adjacent the settling furnace 13. As illustrated in FIGS. 4 and 5, the partition 15 is guided in a groove section 33 cut out of lower manifold 21. Within the groove 33, the partition may be movable by virtue of suspension from a cable 36 running through a longitudinal hole 37 formed along the upper end of the partition 15. As shown in FIGS. 4 and 6, rollers 34 and 35 arranged at opposed ends of the blast furnace along the length of the partition 15 serve to enable movement of the cable and, with it, the partition 15 relative to the wall structure of the smelting and waste-gas stacks 11 and 12.

The partition 15 must be able to withstand very high temperatures since it extends into the molten bath. Preferably, the partition member is made from copper or steel and is formed with internal, longitudinally extending channels 38 which conduct a flow of cooling fluid, such as water, therethrough.

Although various minor modifications may be suggested by those versed in the art, it should be understood that we wish to embody within the scope of the patent warranted hereon all such modifications as reasonably and properly come within the scope of our contribution to the art.

We claim as our invention:

1. A wall structure for a furnace stack comprising a load-bearing lining surface having vertically spaced upper and lower manifold means horizontally enveloping a hot zone in said stack, a membrane wall comprised of a generally annular array of parallel flow pipes interconnected by intermediate wall members and extending vertically between and cooperatively connected with said upper and lower manifold means for conducting a flow of cooling fluid therethrough from one manifold means to the other, said upper and lower manifold means having respective manifold portions projecting inwardly of said membrane wall and defining an alcove space vertically therebetween, and insulation material mounted in said alcove space.

2. The wall structure according to claim 1, wherein said insulation material comprises a plurality of vertically extending lengths separated from one another by transverse gaps, and said membrane wall including a series of sets of flow pipes extending interiorly into said gaps.

3. The wall structure according to claim 1, wherein said upper manifold means is held by support means for suspension of said lining surface.

4. The wall structure according to claim 1, wherein said lining surface is formed in a smelting stack and a portion of said lining surface serves as a common wall between said smelting stack and a waste-gas stack defining a heat removal zone, said smelting stack having fluid passage means connecting the hot zone with the heat removal zone.

5. The wall structure according to claim 4, wherein the remainder waste-gas stack wall structure about said heat removal zone, in addition to said common wall, comprises a continuation of said membrane wall with no insulation material arranged interiorly thereof.

6. The wall structure according to claim 4, wherein said smelting stack and said waste-gas stack are contained within a blast furnace system, said blast furnace system further including a settling furnace means adjacent said smelting stack and said waste-gas stack and a bottom wall means for collecting a common molten smelt bath beneath said smelting stack, waste-gas stack, and settling furnace, a continuation of said membrane wall extending from said smelting stack to form remaining wall structure surrounding said heat removal zone, said membrane wall surrounding said heat removal zone being cooperatively connected with said upper and lower manifold means.

7. The wall structure according to claim 6, further comprising a partition member extending across said bottom wall and into said molten bath to prevent intermixture of gases in said smelting stack and waste-gas stack with gases in said settling furnace and means for suspending said partition member from a portion of said lower manifold means along the length thereof.

8. The wall structure according to claim 7, wherein said suspension means includes a cut-out groove formed in said lower manifold means for receiving an upper end of said partition member and cable means extending through said partition member, said cable means being supported for movement at opposed ends of said blast furnace by roller means.

9. The wall structure according to claim 7, wherein said parition member is formed with fluid flow channels, said fluid flow channels receiving a flow of cooling agent therethrough.

* * * * *